United States Patent [19]

Goodridge

[11] Patent Number: 4,684,335

[45] Date of Patent: Aug. 4, 1987

[54] PUMPS

[75] Inventor: Raymond A. L. Goodridge, Midsomer Norton, United Kingdom

[73] Assignee: Stothert & Pitt PLC, United Kingdom

[21] Appl. No.: 790,820

[22] Filed: Oct. 24, 1985

[30] Foreign Application Priority Data

Oct. 24, 1984 [GB] United Kingdom ..... 8426838

[51] Int. Cl.[4] ..... F04C 18/00

[52] U.S. Cl. ..... 418/189; 418/202

[58] Field of Search ..... 418/201-203, 418/189, 190, 206

[56] References Cited

U.S. PATENT DOCUMENTS

| | | | |
|---|---|---|---|
| 612,304 | 10/1898 | Blazer | 418/201 |
| 1,701,198 | 2/1929 | De C. Tiftt | 418/202 |
| 3,589,843 | 6/1971 | Zalis | 418/202 |
| 3,667,879 | 6/1972 | Cerpelli | 418/202 |

FOREIGN PATENT DOCUMENTS

| | | | |
|---|---|---|---|
| 878844 | 7/1949 | Fed. Rep. of Germany . | |
| 1553214 | 12/1966 | Fed. Rep. of Germany . | |
| 3140042 | 4/1983 | Fed. Rep. of Germany | 418/201 |
| 423269 | 7/1947 | Italy | 418/202 |
| 448235 | 6/1936 | United Kingdom . | |
| 486034 | 5/1938 | United Kingdom . | |
| 629109 | 9/1949 | United Kingdom . | |
| 632364 | 11/1949 | United Kingdom . | |
| 705774 | 3/1954 | United Kingdom . | |
| 890507 | 2/1962 | United Kingdom . | |

*Primary Examiner*—Carlton R. Croyle
*Assistant Examiner*—Jane E. Obee
*Attorney, Agent, or Firm*—Silverman, Cass, Singer & Winburn, Ltd.

[57] ABSTRACT

A screw displacement pump (10) for comingled material has a body (11) defining a chamber (12'). Inlets are provided for the admission of fluid to the chamber and an outlet is provided for discharge of fluid from the chamber (12') intermeshing screw members (40) are mounted for rotation within the chamber (12') for transporting comingled material from the inlet to the outlet, the threads (41,42) of the intermeshing screw members (40) being of opposite hand. The pitch of the screws (40) at the outlet end thereof is smaller than the pitch of the screws (40) at the inlet end thereof to cause compression of gaseous material being transported. Clearance is provided between the screws (40) and between the screws (40) and the walls of the chamber (12') to allow sufficient leakage of the material towards the inlet, when the material is in the liquid phase, to avoid a liquid lock.

6 Claims, 6 Drawing Figures

PUMPS

The invention relates to positive displacement screw pumps.

Positive displacement screw pumps are commonly used for pumping liquids, the screws in the pumps having a constant pitch such that there is no tendency to compress the liquid along the length of the screw and therefore no risk of a liquid lock i.e. a lock effect caused by incompressibility of the liquid.

A problem arises when using such a constant pitch positive displacement screw pump for pumping comingled flows, such as oil and gas mixtures from an oil well, in that, although pumping of the gaseous phase will be achieved, it will not be achieved efficiently since no compression of the gas is taking place along the length of the screw. Output from an oil well will be a mixture of gas and oil which will vary from time to time and the pump must be able, when passing nearly 100% gas, suddenly to accept 100% oil.

According to the invention, there is provided a screw displacement pump for comingled material of different phases such as a liquid phase and a gas phase, the pump comprising a body defining a chamber, at least one inlet and at least one outlet for the admission of fluid to and discharge of fluid from the chamber, a plurality of intermeshing screw members mounted for rotation within the chamber for transporting the comingled material from the inlet to the outlet, the threads of the intermeshing screw members being of opposite hand, wherein the pitch of the screws at the outlet end thereof is smaller than the pitch of the screws at the inlet end thereof to cause compression of gaseous material being transported, and wherein clearance is provided between the screws and between the screws and the walls of the chamber to allow sufficient leakage of the material towards the inlet, when the material is in the liquid phase, to avoid a liquid lock.

The pitch of the screws may vary along the length of the screws, or alternatively the pitch of the screws may decrease in discrete steps from the inlet end thereof to the outlet end thereof. There may be breaks between the threads of the screws at one or more of the discrete steps.

The chamber preferably has one central outlet and two inlets one at each end of the chamber, or a central inlet and two outlets one at each end of the chamber, and one set of screw members mounted for rotation in the housing on each side of the central outlet or inlet, for providing hydraulic balance to the screw members.

By way of example, one embodiment of a pump according to the invention will now be described with reference to the accompanying drawings, in which.

Figure 1:
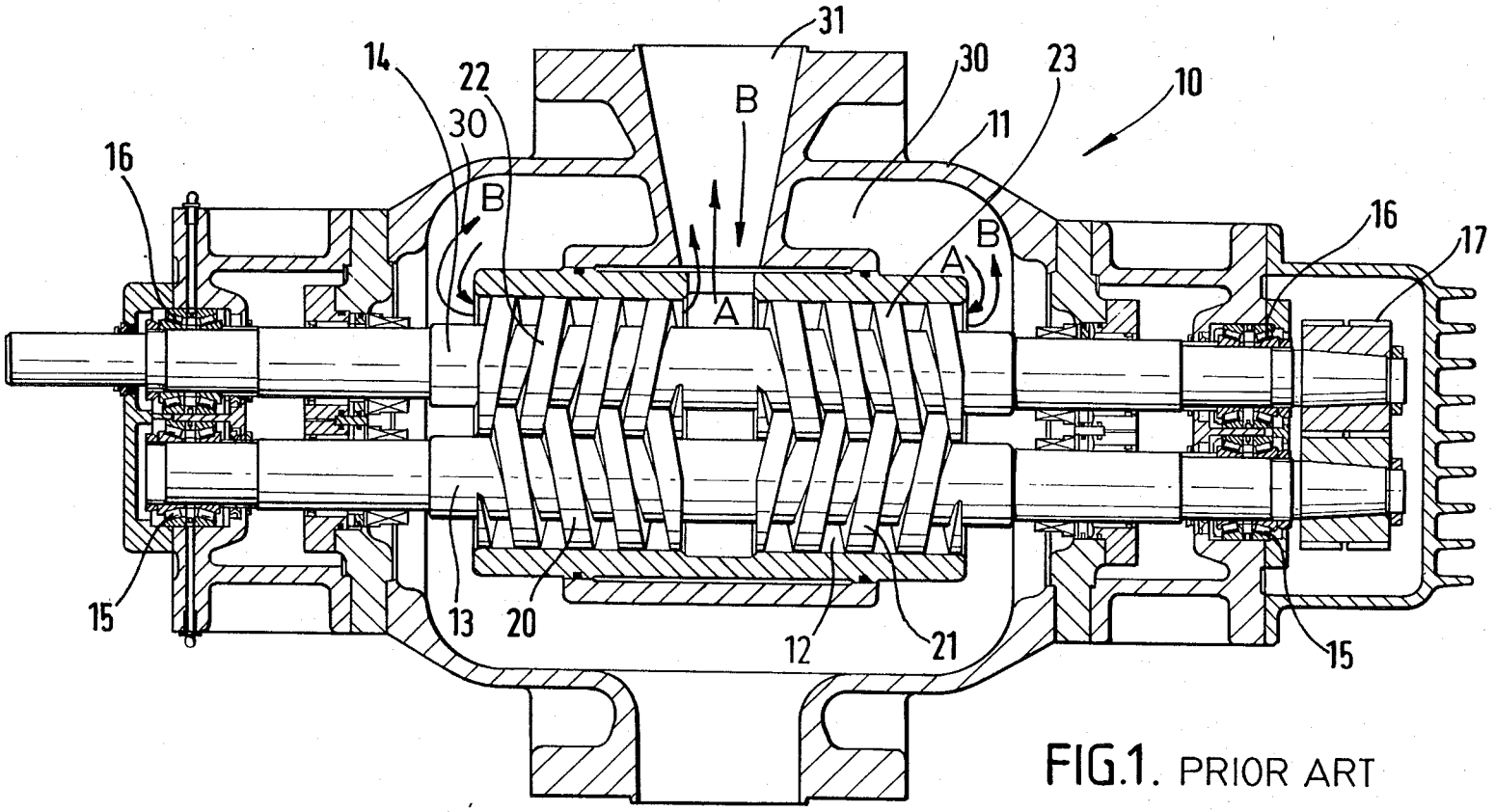
FIG.1. PRIOR ART
FIG. 1 is a sectional view of a conventional screw displacement pump of constant screw pitch.

FIG. 1 shows a known screw displacement pump 10 having a body 11, and a chamber 12 within the body. Operational principles are similar in the conventional pump to the pump according to the invention, and the operational principles of the conventional pump 10 will therefore be described.

Within the chamber 12 are mounted two screw shafts 13, 14 arranged to intermesh. The screw shafts 13, 14 are mounted for rotation in bearings 15, 16, and timing gears 17 on the screw shafts intermesh to ensure that the screw shafts 13, 14 rotate at the same speed in opposite directions.

Each screw shaft 13, 14 has two threaded portions one on each side of a central threadless portion, the two threaded portions of the screw shaft 14 having reference numerals 22 and 23 and the two threaded portions of the screw shaft 13 having reference numerals 20 and 21. The two threaded portions of each screw shaft are of opposite hand, and the meshing threads of the screw shafts 13 and 14 are of opposite hand.

In other words, the threaded portions 20 and 23 have left-hand threads and the threaded portions 21 and 22 have right-hand threads or vice versa.

Inlet to the chamber 12 is at each end thereof from an inlet plenum chamber 30, the screw shafts 13, 14 drawing fluid to the centre of the chamber where fluid is discharged through discharge opening 31.

It will be appreciated by one of ordinary skill in the art that by merely reversing the directions of rotation of screw shafts 13 and 14, plenum chamber 30 would then function to provide an outlet or discharge opening at each end of chamber 12 and opening 3 would function as a central inlet. This reversible nature of the flow is illustrate in FIG. 1 by arrows A, which indicate the direction of flow when plenum chambers 30 act as inlets and opening 31 acts as the outlet, and arrows B, which indicate the direction of flow when the direction of rotation of the screw shafts is reversed and opening 31 acts as an inlet and plenum 30 provides dual outlets.

Figure 2:
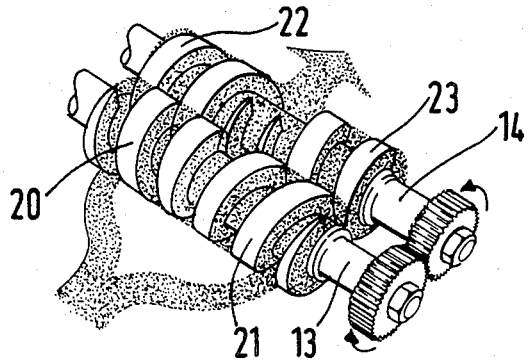
FIG.2. PRIOR ART
FIG. 2 is a view illustrating flow of fluid along the screws of the pump.

FIG. 2 illustrates diagrammatically the flow of fluid along the screw shafts 13 and 14. It will be appreciated that this flow arrangement avoids any net axial thrust on the screw shafts 13 and 14.

It will be appreciated that seals between the screw shafts and the surrounding body 10 are necessary, but these seals are conventional and will not be described in detail.

The pump of FIGS. 1 and 2 is a conventional screw displacement pump, designed for liquid handling. Where comingled flows are to be pumped, the pump of FIGS. 1 and 2 has a disadvantage that it effects no compression of the gas phase during passage along the screws.

Figure 5:
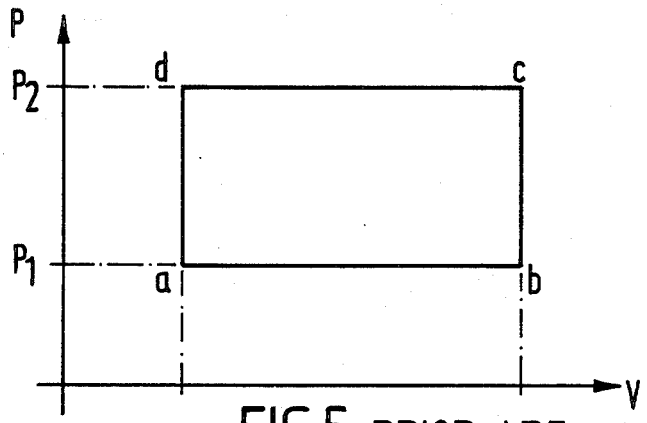
FIG.5. PRIOR ART
FIG. 5 is a pressure-volume diagram for the conventional pump of FIGS. 1 and 2.

The pressure/volume diagram for the conventional screw pump of fixed pitch when passing fluid at the inlet pressure $P_1$ and outlet pressure $P_2$ is illustrated in FIG. 5. Fluid enters the pump inlet at the pressure $P_1$ in the inlet pipe and upon reaching the outlet is suddenly compressed to pressure $P_2$.

The work done by the pump drive is represented by the area abcd, whereas any compresion taking place before discharge will clearly reduce the power consumed.

Figure 3:
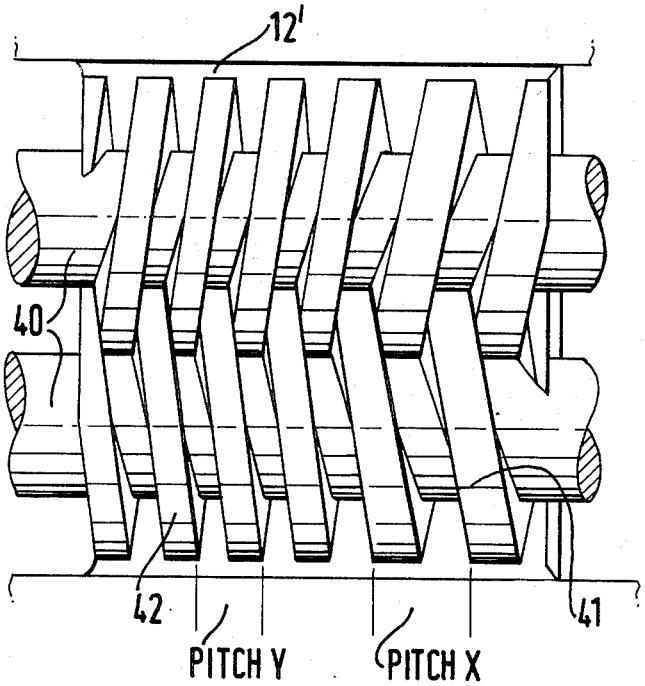
FIG. 3 is a view illustrating a screw having two sections of different pitch and its relationship with a chamber wall; (showing one end of pump only).

FIG. 3 illustrates a threaded portion of one end of screw shafts 40 to one side of the central threadless portion to be used in a pump according to the invention. The body, chamber, drive, bearings and seals of the pump according to the invention will be as already described with reference to FIG. 1, but the screw shafts will both carry threaded portions, each threaded portion having a change of pitch along its length.

In FIG. 3 the screw shafts 40 lie in chamber 12', and there are clearances between the screw shafts and between the chamber wall and the threads of the screw shafts 40. Each screw shaft has a first discrete threaded portion or stage 41 of pitch X at the inlet end of the thread and a second discrete threaded portion or stage 42 of pitch Y smaller than pitch X at the discharge end.

When 100% liquid is being pumped, compression at the transition from pitch X to pitch Y cannot take place and the leakage across the clearances between the chamber wall and the screw shafts 40 and between the intermeshing screw shafts must take place to avoid a liquid lock. The output when 100% liquid is being pumped thus corresponds to the swept volume of the second threaded portion 42.

Figure 4:
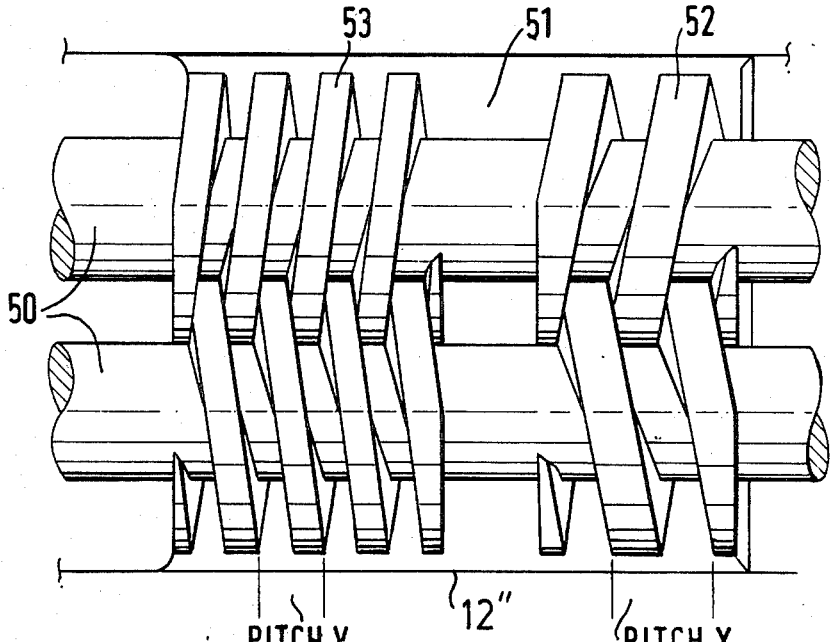
FIG. 4 is a view illustrating a screw having two sections of different pitch and a gap between the two sections, and its relationship with a chamber wall.

FIG. 4 illustrates a threaded portion of screw shafts 40 to be used in a pump according to the invention. The body, chamber, drive, bearings and seals of the pump according to the invention will be as already described with reference to FIG. 1, but as with the embodiment of FIG. 3, the screw shafts 50 will both carry threaded portions, each threaded portion having a change of pitch along its length. In the FIG. 4 embodiment, however, there is a break between the threads of different pitch to provide an intermediate plenum chamber 51.

The screw shafts 50 lie in a chamber 12" and there are clearances between the screw shafts and between the chamber wall and the threads of the screw shafts 50. Each screw shaft 50 has a first threaded portion 52 of pitch X at the inlet end of the thread and a second threaded portion 53 of pitch Y smaller than pitch X at the discharge end. The intermediate plenum chamber 51 lies between the threaded portions 52 and 53.

When 100% liquid is being pumped through a pump having screw shafts of FIG. 3 or FIG. 4, compression at the transition from pitch X to pitch Y cannot take place and leakage across the clearances between the chamber wall and the screw shafts and between the screw shafts must take place at the portions 41 or 52 of larger pitch to avoid a liquid lock. The output when 100% liquid is being pumped thus corresponds to the swept volume of the second threaded portion 42 (for the FIG. 3 embodiment) or 53 (for the FIG. 4 embodiment).

Once the material being pumped includes some gas, compression of the gas in the comingled flow can take place at the transition between the first and second threaded portions 41 and 42 in FIG. 3, or between the threaded portions 52 and 53 in FIG. 4. Once there is a proportion of gas in the comingled flow, an intermediate pressure ($P_R$) level determined by the particular dimensions of the pump and the relationship between the pitches X and Y, is attained, leakage across the threaded portions of larger pitch 41 or 52 is reduced, and the gas in the comingled flow is compressed. allowing sufficient reduction in the volume of the comingled fluid to avoid a liquid lock.

Figure 6:
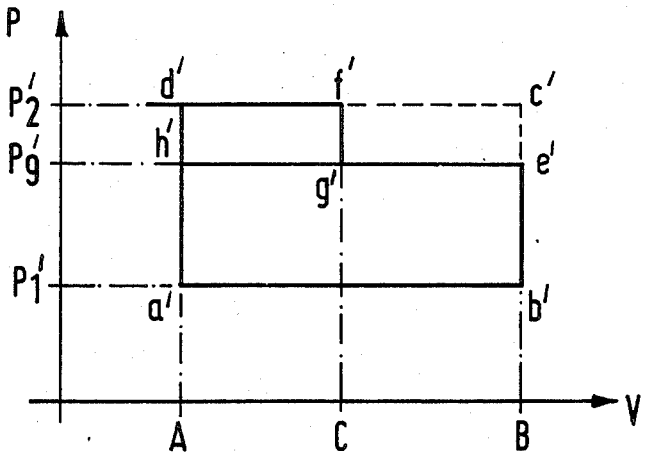
FIG. 6 is a pressure-volume diagram for a pump including the screws of FIG. 4.

The pressure/volume diagram of FIG. 6 shows what happens to the gas in the comingled flow where the proportion of gas in the comingled flow has reached the predetermined level.

Volume A–B represents inlet volume V1 modified by the volumetric efficiency of pitch X in FIGS. 3 and 4 against the differential pressure of P'g–P'1. Volume A–C represents interstage volume Vg modified by volumetric efficiency of pitch Y in FIGS. 3 and 4 against the differential pressure of P'2–P'g to give the final output volume. Pressure P'1 represents inlet pressure. Pressure P'g represents interstage pressure, which is dependent on the pitch ration of X:Y and gas to oil ratio. Pressure P'2 represents outlet pressure (system resistance).

The work done is based on the inlet and interstage volumes V1 and Vg respectively.

The work done with a two pitch configuration of X and Y is as follows:

For pitch X (inlet pitch) with 100% fluid, work done is as FIG. 5, pitch Y having no work input.

For pitch X with gas content, the work done will be to raise volume A–B to intermediate pressure P'g shown on FIG. 6, as the area within a', b', e', h', the gas content being compressed by pressure ration of P'g to P'1 at interstage. For pitch Y (outlet pitch) the lesser volume A–C is raised from P'g to P'2 and work done is represented as h', g', f', d'.

As a smaller volume is being raised to the outlet pressure P'2, the work saving over the single state pump is represented by g', e', c', f'.

It will be appreciated that there must be sufficient liquid phase present to seal the clearances against gas leakage.

Clearly, with a clearance present, if there were no seal, no compression could be achieved. In such a situation, the P-V diagram of FIG. 6 would not be valid.

While screws having two distinct stages have been described, it will be appreciated that the pitch of the threads could be reduced continually along the threaded portions, and that the variation in pitch need not be uniform. Also, there may be more than two distinct pitch changes.

By staging within the pump and balancing pitch ratios, hydraulic lock can be avoided, the pump itself compensating for the various flow regimes.

A significant advantage of this embodiment of the invention is the reduction in power consumption when handling comingled flow as compared to a conventional screw displacement pump.

I claim:

1. A screw displacement pump for comingled material of different phases such as gas phase and a liquid phase, the pump comprising a body defining a chamber, at least one inlet and at least one outlet for the admission of fluid to and discharge of fluid from the chamber, a plurality of intermeshing screw members mounted for rotation within the chamber for transporting the comingled material from the inlet to the outlet, the threads of the intermeshing screw members being of opposite hand, wherein the pitch of the screw members at the outlet end thereof is smaller than the pitch of the screw members at the inlet end thereof to cause compression of gaseous material being transported, and wherein clearances are provided between the screw members and between the screw members and the walls of the chamber to allow sufficient leakage of the material towards the inlet, when the material is in the liquid phase, to avoid a liquid lock.

2. A screw displacement pump as claimed in claim 1 wherein the pitch of the screw members varies along the length of the screw members.

3. A screw displacement pump as claimed in claim 1 having one central outlet and two inlets one at each end of the chamber, the pump comprising one set of screw members mounted for rotation in the housing on each side of the central outlet, for providing hydraulic balance to the screw members.

4. A screw displacement pump as claimed in claim 1 wherein the chamber has a central inlet and two outlets one at each end of the chamber, the pump comprising one set of screw members mounted for rotation in the housing on each side of the central inlet, for providing hydraulic balance to the screw members.

5. A screw displacement pump as claimed in claim 1 wherein the pitch of the screw members decreases in discrete stages from the inlet end thereof to the outlet end thereof.

6. A screw displacement pump as claimed in claim 5 having a break between threads of the screw members at one or more of said discrete stages.

* * * * *